US010112821B2

(12) United States Patent
Vandekerckhove et al.

(10) Patent No.: US 10,112,821 B2
(45) Date of Patent: Oct. 30, 2018

(54) LIQUID DISPENSING APPLIANCE PROVIDED WITH AN ANTI-DRIP VALVE SYSTEM

(75) Inventors: Stijn Vandekerckhove, Brussels (BE); Daniel Peirsman, Brussels (BE)

(73) Assignee: Anheuser-Busch InBev S.A., Brussels (BE)

( * ) Notice: Subject to any disclaimer, the term of this patent is extended or adjusted under 35 U.S.C. 154(b) by 0 days.

(21) Appl. No.: 13/884,499

(22) PCT Filed: Oct. 28, 2011

(86) PCT No.: PCT/EP2011/069000
§ 371 (c)(1),
(2), (4) Date: Sep. 10, 2013

(87) PCT Pub. No.: WO2012/062609
PCT Pub. Date: May 18, 2012

(65) Prior Publication Data

US 2013/0341351 A1 Dec. 26, 2013

(30) Foreign Application Priority Data

Nov. 10, 2010 (EP) ..... 10014452

(51) Int. Cl.
*B67D 3/00* (2006.01)
*B67D 3/04* (2006.01)
(Continued)

(52) U.S. Cl.
CPC ..... *B67D 3/041* (2013.01); *B67D 1/0004* (2013.01); *B67D 1/1405* (2013.01)

(58) Field of Classification Search
CPC .... B67D 3/041; B67D 1/0004; B67D 1/1405; B67D 1/0412; B67D 1/0456;
(Continued)

(56) References Cited

U.S. PATENT DOCUMENTS 2,775,374 A * 12/1956 Tamminga ..... 222/185.1
3,050,216 A * 8/1962 Norris ..... 222/184
(Continued)

FOREIGN PATENT DOCUMENTS

DE 39 20 348 12/1989
DE 93 13 842 11/1993
(Continued)

OTHER PUBLICATIONS

Online article, "Pinch Valve," from http://en.wikipedia.org/wiki/Pinch_valve, printed on Apr. 18, 2013.

*Primary Examiner* — Charles P Cheyney
(74) *Attorney, Agent, or Firm* — Levy & Grandinetti

(57) ABSTRACT

A dispensing assembly having a container containing a liquid to be dispensed and a dispensing tube bringing in fluid communication with ambient the volume inside the container containing the liquid. The dispensing tube has a flexible, resilient portion ending in an outlet of diameter, D, and is engaged in a pinch valve system. The pinch valve system has a squeezing member suitable for squeezing and obturating a section of the flexible portion located at a distance, h, from the outlet. The ratio, h/D, of the distance, h, to the outlet diameter, D, is not more than 2, preferably, not more than 1.5, more preferably, not more than 1.0.

16 Claims, 5 Drawing Sheets

(51) Int. Cl.
*B67D 1/14* (2006.01)
*B67D 1/00* (2006.01)

(58) Field of Classification Search
CPC .. B67D 1/0418; B67D 1/0462; B67D 1/0001; B67D 3/042; B67D 3/047; B05B 1/30
USPC ..... 222/214, 394, 396, 399, 571, 95, 105, 222/529; 251/7
See application file for complete search history.

(56) References Cited

U.S. PATENT DOCUMENTS

| | | | | |
|---|---|---|---|---|
| 3,558,010 | A * | 1/1971 | Zenger et al. | 222/5 |
| 4,186,848 | A | 2/1980 | Walter | |
| 4,463,876 | A | 8/1984 | Swallert | |
| 4,961,508 | A * | 10/1990 | Weimer | B67D 1/0001 222/183 |
| 5,022,565 | A | 6/1991 | Sturman et al. | |
| 5,084,035 | A * | 1/1992 | Salvadori | A61F 5/4407 604/322 |
| 5,499,758 | A | 3/1996 | McCann et al. | |
| 5,979,713 | A * | 11/1999 | Grill | 222/399 |
| 6,261,254 | B1 * | 7/2001 | Baron | A61F 5/4407 604/317 |
| 6,709,420 | B1 * | 3/2004 | Lincoln | A61F 5/4405 251/9 |
| 7,178,699 | B2 | 2/2007 | Spray et al. | |
| 7,721,921 | B2 * | 5/2010 | Ramusch et al. | 222/505 |
| 8,038,039 | B2 * | 10/2011 | Kelly et al. | 222/399 |
| 2006/0118574 | A1 * | 6/2006 | Anderson et al. | 222/1 |
| 2008/0061086 | A1 * | 3/2008 | Kuperus | 222/400.7 |
| 2009/0140006 | A1 | 6/2009 | Vitantonio et al. | |

FOREIGN PATENT DOCUMENTS

| | | |
|---|---|---|
| EP | 0 246 052 | 11/1987 |
| EP | 1 647 499 | 4/2006 |
| FR | 2 602 222 | 2/1988 |
| GB | 887843 | 1/1962 |
| GB | 2 202 836 | 3/1988 |
| GB | 2 237 844 | 11/1989 |
| GB | 2 299 806 | 3/1995 |
| WO | WO 90/15774 | 12/1990 |
| WO | WO 2004/050535 | 6/2004 |
| WO | WO 2005/110912 | 11/2005 |
| WO | WO 2008/129018 | 10/2008 |
| WO | WO 2009/142662 | 11/2009 |
| WO | WO 2010/055057 | 5/2010 |

* cited by examiner

LIQUID DISPENSING APPLIANCE PROVIDED WITH AN ANTI-DRIP VALVE SYSTEM

This Application is the U.S. National Phase of International Application Number PCT/EP2011/069000 filed on Oct. 28, 2011, which claims priority to European Application Number 10014452.6 filed on Nov. 10, 2010.

TECHNICAL FIELD

The present invention relates to a dispensing assembly comprising a container mounted in a dispensing appliance provided with a dispensing tube oriented downwards and a valve for controlling the flow of liquid through said dispensing tube, and substantially reducing, or even preventing dripping of liquid when the valve is closed after each use. The dispensing assembly of the present invention is particularly suitable for dispensing beverages, such as wine, and more particularly carbonated beverages such as beers and sodas.

BACKGROUND OF THE INVENTION

Dispensing containers containing a liquid such as a beverage may require to be mounted into a dispensing appliance for dispensing the liquid contained therein. The dispensing appliance comprises at least one dispensing tube bringing in fluid communication the volume of the container containing the liquid with ambient. This dispensing duct is usually provided with a valve for controlling the flow of liquid out of the container. In order to drive the flow of liquid out of the container, a dispensing appliance usually also comprises means for creating a pressure difference between the interior of the container and ambient to drive the liquid out of the container. Said means may be simply gravity driven, by positioning the dispensing duct below the level of liquid like in old oak barrels for wine or in soap dispensers in public washrooms, but more advantageously, they comprise either means for increasing the pressure inside the container or, alternatively, decreasing the pressure outside the container, such as with a pump. If the pressure is being increased inside the container, such dispensing system is referred to herein as a "pressure dispensing" system, whilst a "vacuum dispensing" system refers to systems where the pressure outside the container is decreased. A pump may be used in both pressure and vacuum dispensing systems. For pressure dispensing systems, however, other means can be used such as pressurized gas stored in a pressure cartridge and/or adsorbed on a carrier. Said means for storing pressurized gas may be provided either in the container or in the appliance. If a source of pressurized gas external to the container is used, the dispensing appliance shall require at least a second, gas tube to be connected to a corresponding aperture in the closure or container body in fluid communication with the interior of the container.

The gas connection may serve either to inject pressurized gas into the container to drive the flow of liquid out of the container ("pressure dispensing" systems), or to allow air into the container to fill the volume of dispensed liquid such as to maintain the pressure relatively constant in the container ("vacuum dispensing" and "gravity dispensing" systems). The container may comprise a single wall (although the wall can be a laminate) or may comprise several detachable layers, such as in bag-in-containers and bladder-in-containers. Bag-in-containers, also referred to as bag-in-bottles or bag-in-boxes depending on the geometry of the outer vessel, all terms considered herein as being comprised within the meaning of the term bag-in-container, are a family of liquid dispensing packaging consisting of an outer container comprising an opening to the atmosphere—the mouth—and which contains a collapsible inner bag joined to said container and opening to the atmosphere at the region of said mouth. The liquid is contained in the inner bag. The system must comprise at least one vent fluidly connecting the atmosphere to the region between the inner bag and the outer container in order to control the pressure in said region to squeeze the inner bag and thus dispense the liquid contained therein (cf. e.g., WO2008/129018 and GB8925324). Alternatively, in bladder-in-containers, the liquid is contained in the outer container and the inner bag, generally called a bladder, is either inflated to drive the flow of liquid out of the container, or simply put in fluid connection with atmospheric, in order to balance the pressure inside the container (cf. WO9015774, EP1647499, WO2010055057, U.S. Pat. No. 5,499,758, GB9504284, FR2602222, GB8806378). The advantage of bag-in-containers and bladder-in-containers over single wall containers is that the liquid is never in contact with an external gas. The present invention applies to any type of containers provided with a closure comprising at least one aperture and is particularly suitable for pressure driven systems, more particularly for bag-in-containers and bladder-in-containers.

The flow through the dispensing tube is generally controlled by a valve. Many types of valves have been used in dispensing appliances. For hygienic reasons, however, as well as for not mixing different tastes when using containers containing different liquids, the dispensing tube is preferably changed with each new container being mounted into the appliance. Of course, each new tube could be provided with a new valve, but this increases the cost of use of such dispensing systems. It is therefore preferred that the valve be part of the dispensing appliance and a disposable dispensing tube of cheap design be inserted and somehow controlled by said valve. An example of a solution to said problem is given in WO2005/110912 wherein a disposable dispensing tube can be mounted with a new container into a spout of the appliance provided with a pinch valve, the portion of said tube coming in contact with the pinch valve being flexible. The outlet of the dispensing tube facing downwards, and the pinching means (110) being located substantially at the elbow formed by the flexible portion of the dispensing tube, before it becomes oriented downwards, there is invariably some dripping of the liquid occurring after each use of the dispensing unit although the valve is in a "closed" position. This drawback can of course somehow be attenuated by using a dripping tray to collect any liquid dripping out of the dispensing tube, but this solution is certainly not optimal as it requires the emptying of the tray at regular intervals, and a tray is not always easy to fit below the dispensing tube, such as for instance for appliances sitting on a shelf of a conventional fridge as disclosed in US2009/0140006, in which a pinching valve is also disclosed in FIGS. 37 & 38, yielding the same problem of dripping after use than the appliance disclosed in WO2005/110912.

There therefore remains a need for a dispensing appliance allowing to easily and economically change the dispensing tube with each new container loaded in said appliance, and yet avoiding or reducing substantially the dripping of liquid after each use of the appliance. The present solution proposes a solution to meet said need. This and other objects of the invention are presented hereinbelow.

SUMMARY OF THE INVENTION

The present invention is defined in the appended independent claims. Preferred embodiments are defined in the dependent claims. In particular, the present invention concerns a dispensing assembly comprising a container containing a liquid to be dispensed, a dispensing tube bringing in fluid communication with ambient the volume inside the container containing the liquid, said dispensing tube having a flexible, resilient portion ending in an outlet (10OUT) of diameter, D, and being engaged in a pinch valve system comprising a squeezing member suitable for squeezing and obturating a section of the flexible portion located at a distance, h, from the outlet, characterized in that, the ratio, h/D, of the distance, h, to the outlet diameter, D, is not more than 2, preferably, not more than 1.5, more preferably, not more than 1.0.

A preferred assembly according to the present invention comprises:

(a) a container containing a liquid to be dispensed and comprising a body, a mouth, and a closure, said closure comprising at least one dispensing opening;

(b) an appliance suitable for receiving said container and for dispensing a liquid contained in said container, said appliance comprising a dispensing portion comprising a dispensing spout out of which the liquid may flow from the container;

(c) a dispensing tube having an inlet end introduced in the closure's dispensing opening in fluid contact with the interior of the container and an outlet end in fluid contact with ambient, wherein at least a portion of said dispensing tube including the outlet is made of a flexible, resilient material, said flexible portion being inserted in the dispensing spout, (d) a valve system suitable for controlling the flow of liquid through the dispensing tube, said valve system comprising a squeezing member for controllably squeezing a section of the flexible portion of the dispensing tube, said squeezing member being located such as to contact the flexible portion of the dispensing tube at a distance, h, from the outlet end thereof, such that the ratio of the distance, h, to the outlet diameter, D, is not more than 2, preferably, not more than 1.5, more preferably, not more than 1.0.

In a preferred embodiment, the squeezing member can be moved from a "closed" position squeezing the flexible portion to an "open" position releasing the compressive pressure on the flexible portion by actuation of a lever.

The distance, h, is preferably less than 15 mm, more preferably the distance, h, is comprised between 1 and 12 mm, most preferably, between 2 and 10 mm, whilst the outlet diameter, D, is preferably at least 0.5 mm, more preferably at least 3 mm, most preferably at least 5 mm, and even at least 10 mm.

In particular for home beverage appliances, the dispensing tube is advantageously encased in a cartridge and forms smooth curves with an angle, α, between the longitudinal axes of the inlet and outlet comprised between 85 and 135 deg. The inlet end of the dispensing tube is preferably sufficiently sharp and hard to be suitable for unsealing an initially sealed dispensing opening of the closure of the container.

The dispensing system of the present invention is particularly suitable for pressure driven dispensing systems. In particular, it is suitable for systems wherein the container is a bag-in-container and for beverage dispensing systems, in particular carbonated beverages like beer and sodas.

BRIEF DESCRIPTION OF THE FIGURES

For a fuller understanding of the nature of the present invention, reference is made to the following detailed description taken in conjunction with the accompanying drawings in which.

DETAILED DESCRIPTION OF THE INVENTION

Figure 1:
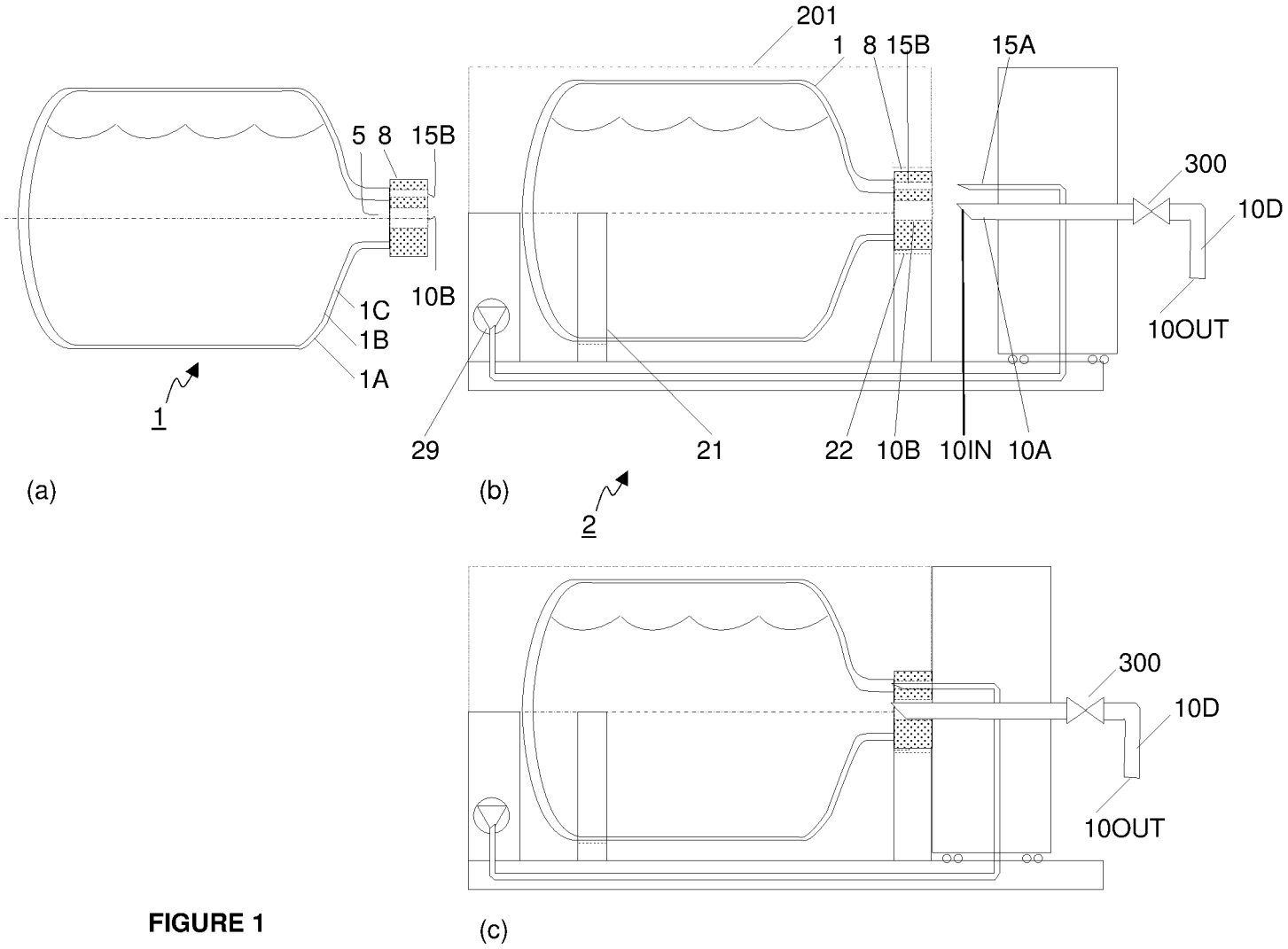
FIG. 1: shows a dispensing assembly.

As can be seen in FIG. 1, a dispensing assembly comprises a container (1) and a dispensing appliance (2). The container (1) illustrated in FIG. 1(*a*) is a bag-in-container, comprising a collapsible flexible inner layer (1B) (the bag) containing the liquid and an outer layer (1A) and defining a space or an interface (1C) between the two layers. Bag-in-containers are particularly preferred, but the present invention is not restricted to bag-in-containers and can be used with any container provided with at least a dispensing aperture (10B), preferably disposed in a closure (8), allowing the volume containing the liquid to be brought in fluid communication with ambient. In most cases, said dispensing aperture (10B) is sealed before use and it must be unsealed upon mounting the container in the appliance (2). The closure illustrated in FIGS. 1(*a*) and 5 comprises a second opening (15B) for engaging a second tube, such as a gas tube for injecting pressurized gas from a source of pressurized gas (29) into the container. A second opening is not necessary for e.g., gravity dispensing systems, wherein the dispensing tube is located below the level of liquid in the container or, if necessary, it shall be located above the level of the liquid in order to balance the pressure with ambient upon dispensing.

The dispensing appliance (2) comprises a holding portion (201) for holding the container in position with holding means (21, 22) and a dispensing portion (202) comprising a dispensing tube (10A) suitable for fluidly connecting the volume containing the liquid with ambient. In the embodiment depicted in FIG. 1, the flow of liquid out of the container is driven, by increasing the pressure in the space (1C) by injecting pressurized gas between the inner and outer layers (1A, 1B) of the container from the pump (29) through the gas tube (15A). The flow of liquid through the dispensing tube (10A) is controlled by a valve (300) located between the dispensing tube inlet (10IN) and outlet (10OUT). In use, the container (1) is preferably first loaded into the holding portion (201) of the appliance. Then, the dispensing tube (10A) and any other tubing (15A) are engaged into the corresponding openings (10B, 15B) in the closure (8) of the container. Preferably, as illustrated in FIG. 1, the engagement of the tubing (10A, 15A) is performed by moving the dispensing portion (201) from a first, loading position (cf. FIG. 1(*b*)) to a second, dispensing position (cf. FIG. 1(*c*)).

The dispensing tube (10A) shall be periodically changed, preferably with each new container (1) mounted in the dispensing appliance (2) for hygienic reasons as well as for not mixing tastes in case a container containing a beverage different from the one dispensed from the prior container is used. In order to reduce the cost of a disposable dispensing tube (10A), the valve system (300) controlling the flow through said dispensing tube is permanently part of the dispensing portion (202) of the dispensing appliance (2) and a flexible portion (10D) of the dispensing tube is engaged in said valve system (300). According to the present invention, at least the portion (10D) extending from the point where the dispensing tube is engaged in the valve system (300) downstream to the outlet (10OUT) is made of a resilient, flexible material, such as a rubber, a thermoplastic elastomer (TPE) and the like. The material must retain its resiliency and flexibility at temperatures ranging from 2° C. as can be encountered in a conventional fridge, to up to about 40° C., if the appliance is exposed to the sun. For example, the flexible portion (10D) of the dispensing tube (10A) can be made of natural rubber or of any of the following synthetic rubbers: Bromo Isobutylene Isoprene (BIIR), Polybutadiene (BR), Chloro Isobutylene Isoprene (CIIR), Polychloroprene (CR), Chlorosulphonated Polyethylene (CSM), Epichlorohydrin (ECO), Ethylene Propylene (ECO), Ethylene Propylene Diene Monomer (EPDM), Fluoronated Hydrocarbon (FKM), Fluoro Silicone (FVQM), Hydrogenated Nitrile Butadiene (HNBR), Polyisoprene (IR), Isobutylene Isoprene Butyl (IIR), Methyl Vinyl Silicone (MVQ), Acrylonitrile Butadiene (NBR), Polyurethane (PU), Styrene Butadiene (SBR), Styrene Ethylene/Butylene Styrene (SEBS), Polysiloxane (SI), Acrylonitrile Butadiene Carboxy Monomer (XNBR), and the like.

Figure 2:
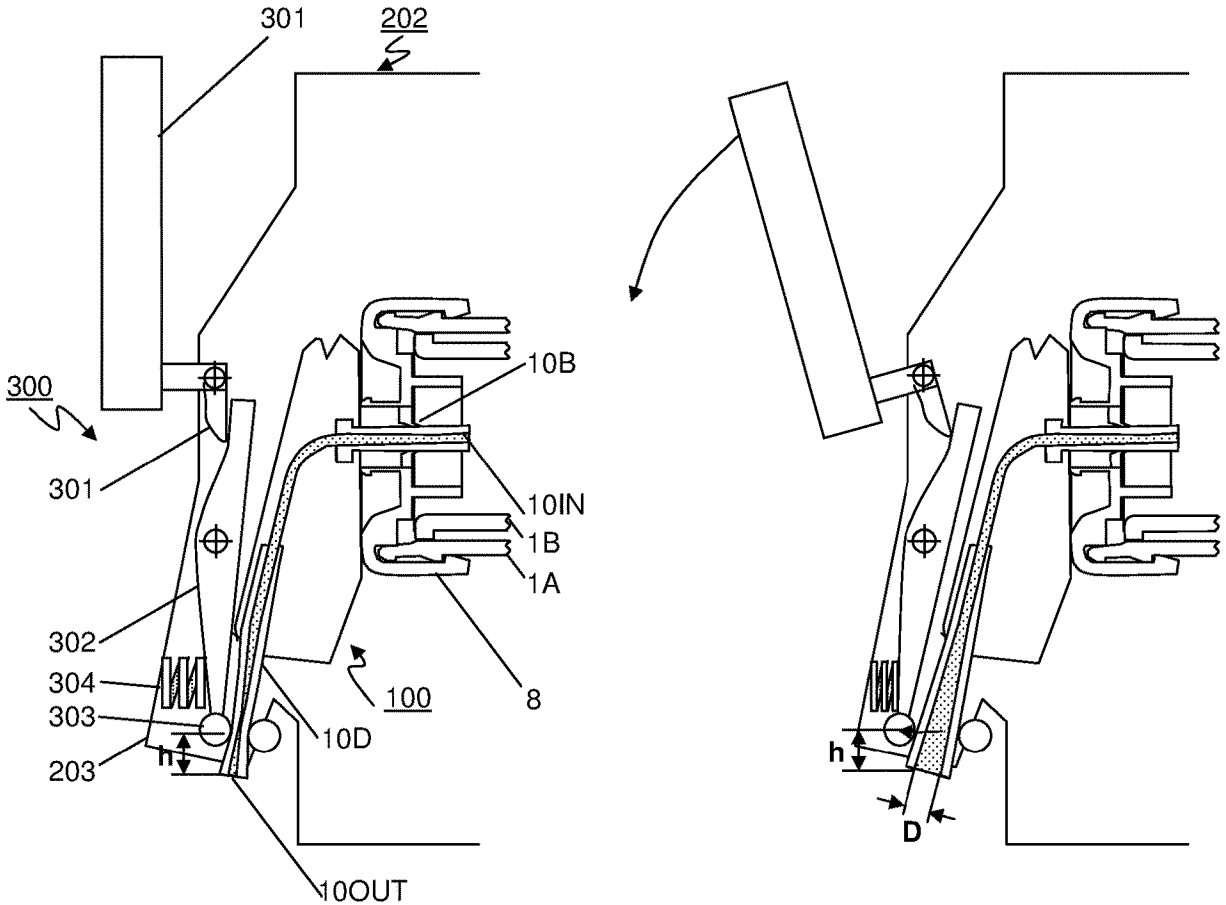
FIG. 2: shows the dispensing portion of a dispensing assembly according to the present invention.

The valve system (300) of the present invention is a so-called pinch valve comprising a squeezing member (303) suitable for controllably squeezing a section of the flexible portion (10D) of the dispensing tube (10A) until sealing the passage therethrough (for general information on pinch valves, cf. e.g., http://en.wikipedia.orq/wiki/Pinch_valve). The squeezing member (303) may comprise one or more movable parts, which combined movements are suitable for obturating the passage through the flexible portion (10D) of the dispensing tube. The squeezing member generally comprises two complementary surfaces which can be moved to be brought together with the flexible portion (10D) of the dispensing tube caught in between. In the embodiment illustrated in FIG. 2, a squeezing member (303) can be moved by actuating a lever (301) to squeeze the flexible portion (10D) of the dispensing tube against a fixed surface, which can be prismatic as depicted in FIG. 2, flat, or forming a cradle mating the geometry of the squeezing member (303). Many mechanisms are known to the person skilled in the art for bringing together two complementary surfaces with a flexible tube caught in between. In the embodiment illustrated in FIG. 2, a shaft (202) pivotally mounted between the proximal and the distal ends thereof and comprising at its distal end a squeezing means (303). Resilient means (304) naturally biase the shaft (302) such that the squeezing means (303) presses against the flexible portion (10D) of the dispensing tube (10A) against a fixed surface of the spout (203) of the dispensing portion (202), such that no flow occurs through the dispensing tube. Opening of the valve system (300) can be actuated by any means such as a lever (301), which is particularly appreciated for beer dispensing appliances as it reminds of the tap in pubs. In FIG. 2, rotation of the lever (301) by a user presses the proximal end of shaft (302), which pivots like a seesaw such that the squeezing means (303) releases the pressure against the flexible portion (10D) of the dispensing tube (10A), thus allowing the liquid contained in the container to flow through the dispensing tube. Instead of a shaft (302) pivotally mounted and comprising at its distal end a squeezing means, other squeezing means can be used, such as for example a cam which rotation can be driven by actuation of a lever (301) to bring in or out of contact a squeezing means (303) as disclosed in WO2005/110912. Other pinch valve systems can be applied to the present invention, which are disclosed in e.g., DE3920348, WO2004/050535, WO2009/142662, U.S. Pat. No. 4,186,848, U.S. Pat. No. 5,022,565, or US2005072806. Actuation can be driven mechanically as discussed above, e.g., with a lever (301), or electrically. At least one of the two complemenrary surfaces forming the squeezing members (303) should be rounded with as small a radius as possible, so that a high squeezing stress can be applied to the flexible tube with a low force by an operator or a biasing means. The radius should not, however, be so thin that it could damage the tube, e.g., by indenting it or even cutting it. The radius of the rounded portion of at least one of the two complemenrary surfaces forming the squeezing members (303) is preferably comprised between 0.2 and 3 mm, preferably between 0.3 and 1 mm, more preferable between 0.4 and 0.7 mm.

Figure 3:
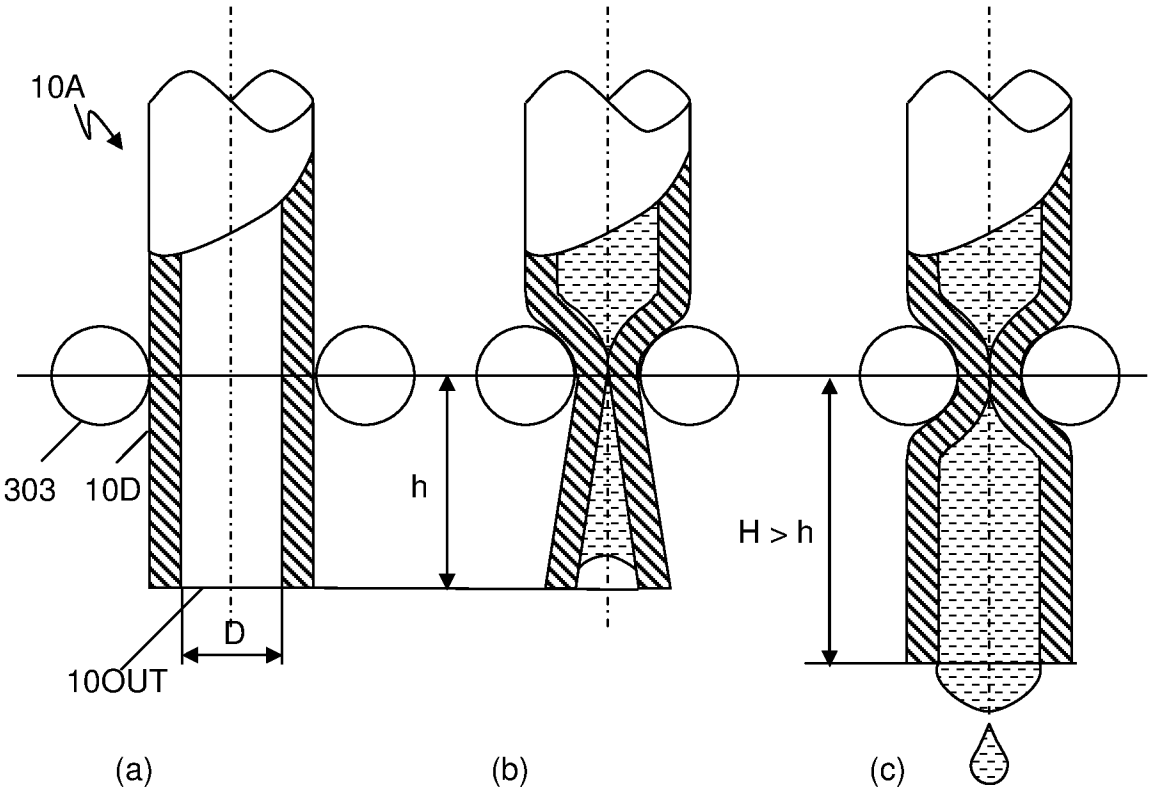
FIG. 3: shows a flexible dispensing tube portion engaged in a pinch valve (a) open; (b) closed according to the present invention; and (c) closed according to prior art.

As illustrated in FIG. 3(*c*), regardless of the squeezing mechanism used, drops of liquid invariably drip out of a downwardly oriented dispensing tube directly after interrupting a dispensing operation by closing a pinch valve as used to date in dispensing appliances. This is because after closing of the valve system (300) the outlet (10OUT) of the flexible dispensing tube (10A, 10D) remains open and oriented downwards, so that any liquid still remaining in the dispensing tube downstream from the squeezing means (303) will invariably drip down. To solve this problem in a simple and economic way, it has been found that dripping can be substantially reduced and even stopped if the squeezing means (303) are located at a distance, h, sufficiently close to the flexible tube outlet (10OUT) of diameter, D, such that the ratio, h/D, of the distance, h, to the outlet diameter, D, is not more than 2, preferably, not more than 1.5, more preferably, not more than 1.0. If the dispensing tube is not cylindrical, e.g., trunco-conical, the value of the outlet diameter, D, is the inner diameter measured at the very outlet of the tube at rest (i.e., not strained). If the outlet is not circular, the value of the diameter, D, has the value of the hydraulic diameter, $D_H$=4 A/P, wherein A is the cross-sectional area, and P is the perimeter of the outlet (10OUT). Without wishing to be bound by any theory, it is believed that several factors contribute to the substantial reduction, and even elimination of undesired dripping after closing the valve.

First, there is a kinetic aspect. The liquid flowing out of the dispensing tube has a certain kinetic energy, ½ m $v^2$, (where m is the mass and v the velocity of the liquid downstream of the closed valve); which rapidly dissipates with friction against the tube wall. The magnitude of energy dissipation is proportional to the distance, h. It follows that with a large diameter, D, the kinetic energy is greater than with a lower diameter, D, because the mass, m, is proportional to the square of the diameter, D, and, concomitantly, the liquid reaches the outlet (10OUT) with less energy losses when the distance, h, is lower. This means that a drop of liquid will reach the outlet (10OUT) with more energy if the ratio, h/D, is low, thus ejecting a greater volume of liquid out of the tube portion downstream of the closed valve (300), and thus letting a smaller amount of liquid in the tube. Letting a smaller amount of liquid in the dispensing tube downstream of the valve has further effects, as discussed below.

Second, there is a capillary aspect. Since the outlet (10OUT) is facing downwards, two forces compete: the gravity force, which tends to drag the remaining volume of liquid out of the dispensing tube, and the capillary forces, which tend to hold the remaining volume of liquid within the tube. As illustrated in FIG. 3(*c*), the greater the volume of liquid left in the dispensing tube portion downstream of the valve, the greater the effect of the gravitational force, until it exceeds the capillary forces and the liquid will start dripping. It is clear that if the distance, H, from the squeezing member (303) to the outlet (10OUT) is greater than, h, as defined herein, the volume—i.e., mass-of liquid is greater and the gravitational force will exceed the capillary forces. On the other hand, as illustrated in FIG. 3(*b*), if the volume of liquid remaining in the dispensing tube is small, the capillary forces are greater than the gravitational forces, and the liquid drop is held in the tube and no dripping occurs.

It has been found that good results were obtained when the distance, h, is less than 15 mm, preferably the distance, h, is comprised between 1 and 12 mm, more preferably, between 2 and 10 mm, whilst the outlet diameter, D, is at least 0.5 mm, preferably at least 3 mm, more preferably at least 5 mm, most preferably at least 10 mm. For a beer dispensing system, the diameter, D, of the outlet (10OUT) is preferably comprised between 5 and 7 mm, more preferably between 5.5 and 6.5 mm.

In a preferred embodiment, the dispensing tube (10A) is encased in a cartridge (100) with the flexible portion (10D) thereof protruding out of a first face of the cartridge, and the inlet end (10IN) protruding out of a second face of said cartridge. If the container is to be held horizontally in the dispensing unit, the longitudinal axes of the inlet portion (10IN) and outlet (10OUT) form an angle comprised between 85 and 145 deg, preferably between 90 and 135 deg. In case the container stands vertically, with the closure up, then the longitudinal axis of the inlet (IN) and outlet (10OUT) form an angle comprised between 0 and 45 deg, the tube drawing a curve like a reversed "U". It is preferred that the dispensing tube (10A) comprises no sharp angle to prevent excessive formation of froth in case of gaseous beverages, such a beer and sodas. It may comprise a pressure reduction portion wherein the tube forms curves and/or the cross-section thereof varies in order to create a pressure drop in the liquid, but said pressure reduction portion should preferably not comprise any sharp angle.

Figure 4:
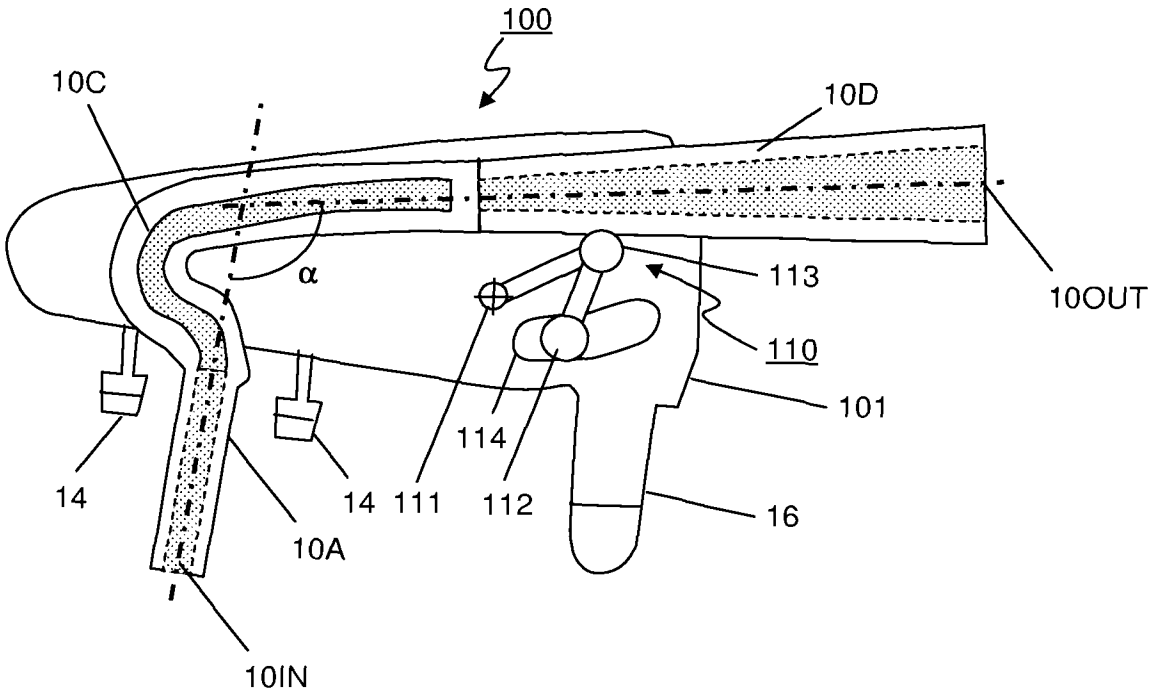
FIG. 4: shows a dispensing tube encased in a dispensing cartridge.
Figure 5:
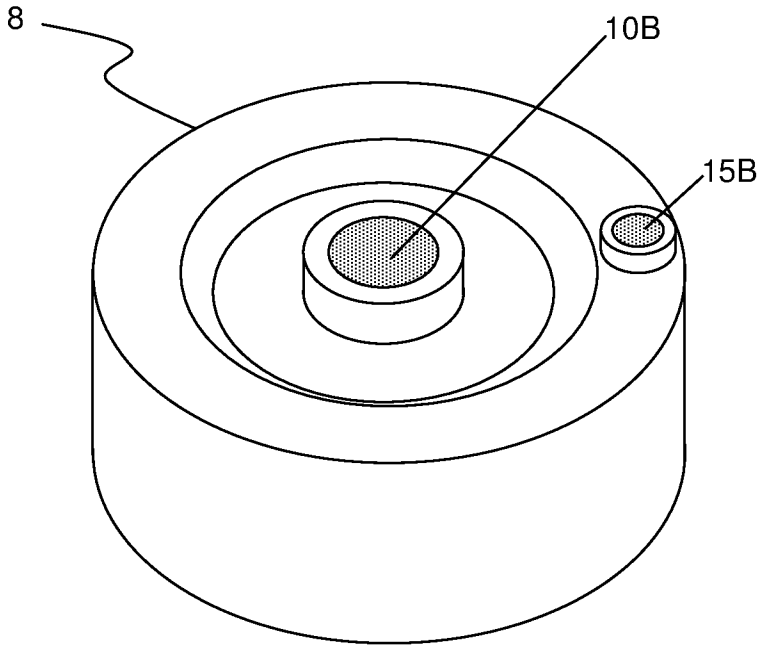
FIG. 5: shows a closure suitable for being used with the assembly of the present invention.

The inlet portion (10IN) of the dispensing tube (10A) must be suitable for piercing an initially sealed opening (10B) in the closure of the container (1). It is therefore preferably made of a rigid material, like PE, PP, PET, and the like, and its edges are preferably sharp. The flexible portion (10D) of the dispensing tube may form substantially the whole length of the dispensing tube, the sharp inlet being formed by a ring inserted in one end of the flexible tube (10D) and held in place by the case of the cartridge in which it is engaged. Alternatively, a portion of the dispensing tube may be formed by two channels formed on two opposed half shells, which, upon assembly form a closed channel in the cartridge. This embodiment, illustrated in FIG. 4, is particularly suitable when a pressure reducing channel is desired. The flexible portion (10D) can be joined upon assembly of the two half shells in continuation of said channel by welding, gluing, over-injecting or any other technique known to the person skilled in the art, and protrude out of the cartridge with a length suitable for engaging into the valve system (300) of the dispensing portion (202) of the dispensing appliance, and preferably substantially flush with the outlet of the spout (203) of the dispensing portion (202).

The cartridge may be provided with fixing means (16) for fixing it to the dispensing appliance. If the dispensing opening (10B) of the closure of the container (1) cannot be sealed back after removal of the dispensing tube, it may be preferable to not disengage the dispensing tube (10A) and cartridge (100) from the closure after removal of the container from the dispensing appliance and to provide the cartridge with a secondary pinch valve (110) automatically squeezing a flexible section (10D) of the dispensing tube upon removal thereof from the appliance. In this embodiment, the cartridge preferably comprises snap fitting means (14) for fixing the cartridge to the closure (8). This has the advantage that a half full container may be removed to mount another container, and yet still ensure that the removed container is sealed. If the old container is mounted back into the dispensing appliance, the secondary pinch valve (110) opens automatically upon engagement of the cartridge into the dispensing portion (202). It can thus be stored and used again later if desired. If the dispensing opening (10B) of the closure (8) can be sealed back after removal of the dispensing tube, then the cartridge (100) may be removed from the container and a secondary pinch valve (110) is not necessary anymore.

The invention claimed is:

1. A pressure driven dispensing assembly comprising a container containing a beverage to be dispensed, a dispensing tube bringing in fluid communication with ambient the volume inside the container containing the beverage, and a source of pressurized gas in fluid communication with the interior of the container for pressurizing the interior of the container and driving the dispensing of the beverage out of the container through the dispensing tube, said dispensing tube having a flexible, resilient portion ending in an outlet of inner diameter, D, is at least 3 mm, and being engaged in a pinch valve system comprising a squeezing member suitable for squeezing and obturating a single section of the flexible portion located at a distance, h, from the outlet comprised between 1 and 12 mm, wherein the ratio, h/D, of the distance, h, to the outlet inner diameter, D, is not more than 1.5, so as to reduce the dripping of the beverage out of the dispensing tube when obturating the section.

2. The dispensing assembly according to claim 1 wherein, (a) the container comprises a body, a mouth, and a closure, said closure comprising at least one dispensing opening;

(b) the assembly further comprises an appliance suitable for receiving said container and for dispensing a beverage contained in said container, said appliance comprising a dispensing portion comprising the pinch valve system, (c) the dispensing tube has an inlet end introduced in the closure's dispensing opening in fluid contact with the interior of the container and the flexible portion is inserted in the valve of the dispensing portion and the outlet faces downwards.

3. The dispensing assembly according to claim 2, wherein the squeezing member can be moved from a "closed" position squeezing the flexible portion to an "open" position releasing the compressive pressure on the flexible portion by actuation of a lever.

4. The dispensing assembly according to claim 3, wherein the squeezing member comprises two complementary surfaces which can be moved relative to each other to be brought together with the flexible portion of the dispensing tube caught in between, and wherein at least one of the two complementary surfaces has a rounded portion in contact with the flexible tube portion of radius comprised between 0.2 and 3 mm.

5. The dispensing assembly according to claim 4, wherein the flexible portion of the dispensing tube is made of a natural or synthetic rubber, or a thermoplastic elastomer.

6. The dispensing assembly according to claim 5, wherein the dispensing tube is encased in a cartridge, forms smooth curves, and the longitudinal axes of the inlet and outlet form an angle, α, comprised between 85 and 145 deg.

7. The dispensing assembly according to claim 6, wherein the inlet end of the dispensing tube is suitable for unsealing an initially sealed dispensing opening of the container.

8. The dispensing assembly according to claim 1, wherein the container is a bag-in-container.

9. The dispensing assembly according to claim 8, wherein the beverage contained in the container is a carbonated beverage.

10. The dispensing assembly according to claim 1, wherein the squeezing member can be moved from a "closed" position squeezing the flexible portion to an "open" position releasing the compressive pressure on the flexible portion by actuation of a lever.

11. The dispensing assembly according to 1, wherein the squeezing member comprises two complementary surfaces which can be moved relative to each other to be brought together with the flexible portion of the dispensing tube caught in between, and wherein at least one of the two complementary surfaces has a rounded portion in contact with the flexible tube portion of radius comprised between 0.2 and 3 mm.

12. The dispensing assembly according to claim 1, wherein the flexible portion of the dispensing tube is made of a natural or synthetic rubber, or a thermoplastic elastomer.

13. The dispensing assembly according to claim 1, wherein the dispensing tube is encased in a cartridge, forms smooth curves, and the longitudinal axes of the inlet and outlet form an angle, α, comprised between 85 and 145 deg.

14. The dispensing assembly according to claim 1, wherein the beverage contained in the container is a carbonated beverage.

15. The dispensing assembly according to claim 14, wherein the beverage contained in the container is beer.

16. The dispensing assembly according to claim 1, wherein the ratio, h/D, of the distance, h, to the outlet inner diameter, D, is not more than 1.0.

* * * * *